US010636386B2

(12) United States Patent
Su et al.

(10) Patent No.: US 10,636,386 B2
(45) **Date of Patent: *Apr. 28, 2020**

(54) DISPLAY DEVICE WITH NOVEL SUB-PIXEL CONFIGURATION

(71) Applicant: NOVATEK Microelectronics Corp., Hsin-Chu (TW)

(72) Inventors: Shang-Yu Su, New Taipei (TW); Feng-Ting Pai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/368,871

(22) Filed: Mar. 29, 2019

(65) Prior Publication Data

US 2019/0228741 A1 Jul. 25, 2019

Related U.S. Application Data

(63) Continuation of application No. 15/803,842, filed on Nov. 6, 2017, now Pat. No. 10,283,086.

(51) Int. Cl.

| | |
|---|---|
| ***G09G 5/02*** | (2006.01) |
| ***G09G 5/10*** | (2006.01) |
| ***G09G 3/20*** | (2006.01) |

(52) U.S. Cl.

CPC ..... *G09G 5/10* (2013.01); *G09G 3/20* (2013.01); *G09G 3/2003* (2013.01); *G09G 5/02* (2013.01); *G09G 2300/0439* (2013.01); *G09G 2300/0452* (2013.01); *G09G 2300/0465* (2013.01); *G09G 2320/043* (2013.01); *G09G 2340/0457* (2013.01)

(58) Field of Classification Search

CPC ..... G09G 3/3208; G09G 3/3607; G09G 5/02; G09G 5/10; G09G 2300/0439; G09G 2300/0452; G09G 2320/043; H01L 24/3218

See application file for complete search history.

(56) References Cited

U.S. PATENT DOCUMENTS

| | | | |
|---|---|---|---|
| 9,887,247 | B2 | 2/2018 | Yang |
| 9,960,210 | B2 | 5/2018 | Huangfu |
| 2007/0057963 | A1 | 3/2007 | Brown Elliott |
| 2007/0064020 | A1 | 3/2007 | Credelle |
| 2008/0049048 | A1 | 2/2008 | Credelle |
| 2009/0027425 | A1 | 1/2009 | Park |
| 2013/0307868 | A1 | 11/2013 | Jeong |
| 2015/0015466 | A1 | 1/2015 | Feng |
| 2016/0055808 | A1 | 2/2016 | Guo |
| 2016/0189669 | A1 | 6/2016 | Yang |
| 2018/0211580 | A1 | 7/2018 | Su |
| 2019/0035861 | A1 | 1/2019 | Wang |

*Primary Examiner* — Joe H Cheng

(74) *Attorney, Agent, or Firm* — Winston Hsu

(57) ABSTRACT

A display device includes a plurality of sub-pixel arrays and each of sub-pixel arrays includes a plurality of first sub-pixels having a first color and forming a plurality of vertexes of a virtual quadrilateral, wherein there is not any other first sub-pixels having the first color located in the virtual quadrilateral; at least one second sub-pixel, having a second color different from the first color and located in the virtual quadrilateral; and at least one third sub-pixel, having a third color different from the first color and the second color and located in the virtual quadrilateral.

35 Claims, 17 Drawing Sheets

DISPLAY DEVICE WITH NOVEL SUB-PIXEL CONFIGURATION

CROSS REFERENCE TO RELATED APPLICATIONS

This application is a continuation application of U.S. application Ser. No. 15/803,842, filed on Nov. 6, 2017, now U.S. Pat. No. 10,283,086 B1, the contents of which are incorporated herein by reference.

BACKGROUND OF THE INVENTION

1. Field of the Invention

The present invention relates to a display device, and more particularly, to a display device with a novel sub-pixel configuration.

2. Description of the Prior Art

As computer technology advances and as Internet and multimedia are highly being developed, current information is transmitted in digital form instead of analog form, and novel display apparatuses are being invented. A flat panel display fabricated with optoelectronic technology and semiconductor process, such as a liquid crystal display (LCD), an organic light emitting display (OLED), an LED display, a micro or mini LED display, an E-ink display, or a plasma display panel (PDP) display, is becoming main trend of research and development. LCD and OLED display devices which have the advantages of low radiation, light weight and low power consumption are widely used in various information technology (IT) products, such as notebook computers, personal digital assistants (PDA), and mobile phones. Other display devices have also being increasingly developed.

An image quality of the display can be determined via counting a number of pixels located in a direction. For example, the user may acquire a reference of determining the image quality of the display via calculating the pixels per inch (PPI). Generally, the image quality of the display is proportional to the PPI. In recent years, the requirement of the image quality gradually grows and the PPI of the display keeps increasing with the image quality. Because the number of the pixels in a unit area increases, the display needs to spend more layout area on the conductor line routing. The transmittance and the luminance of the display decrease with the PPI, therefore. Furthermore, the increased PPI may cause difficulty in the process of manufacturing the display (e.g. a fine-metal process). Thus, how to improve the transmittance and the luminance of the display and reduce the difficulty of manufacturing the display when increasing the PPI becomes a topic to be discussed.

However, all types of display devices face a problem that the aperture ratio is decreased when the resolution the display device increases. This problem is particularly severe for OLED display devices, whose yield rates may be reduced due to limitations of fine metal mask process and whose decrease in aperture rate may cause life time of the display device to be shorter.

SUMMARY OF THE INVENTION

In order to solve the above issues, the present invention provides a display device with a novel sub-pixel configuration.

In an example, the present invention discloses a display device comprising a plurality of sub-pixel arrays. Each of sub-pixel arrays includes a plurality of first sub-pixels having a first color and forming a plurality of vertexes of a virtual quadrilateral, wherein there is not any other first sub-pixels having the first color located in the virtual quadrilateral; at least one second sub-pixel, having a second color different from the first color and located in the virtual quadrilateral; and at least one third sub-pixel, having a third color different from the first color and the second color and located in the virtual quadrilateral.

In another example, the present invention discloses a driving device, capable for driving a display panel comprising a plurality of sub-pixel arrays. Each of sub-pixel arrays comprises a plurality of first sub-pixels having a first color, forming a plurality of vertexes of a virtual quadrilateral, wherein there is not any other first sub-pixels having the first color located in the virtual quadrilateral; at least one second sub-pixel having a second color different from the first color, located in the virtual quadrilateral; and at least one third sub-pixel having a third color different from the first color and the second color, located in the virtual quadrilateral, wherein the display panel is divided into a plurality of pixel units each containing at least a part of one of the sub-pixel arrays or one or more of the sub-pixel arrays. The driving device comprises a source driving circuit, having one or more output terminals, wherein each output terminal is configured to output a respective drive voltage for driving sub-pixels belonging to at least one corresponding pixel unit of pixel units among the pixel units of the display pane.

In yet another example, the present invention discloses a display device, comprising a display panel, comprising a plurality of sub-pixel arrays, wherein each of sub-pixel arrays comprises a plurality of first sub-pixels having a first color, forming a plurality of vertexes of a virtual quadrilateral, wherein there is not any other first sub-pixels having the first color located in the virtual quadrilateral; at least one second sub-pixel having a second color different from the first color, located in the virtual quadrilateral; and at least one third sub-pixel having a third color different from the first color and the second color, located in the virtual quadrilateral, wherein the display panel is divided into a plurality of pixel units each containing at least a part of one of the sub-pixel arrays or one or more of the sub-pixel arrays; and a driving device, configured to drive the pixel units on the display panel.

These and other objectives of the present invention will no doubt become obvious to those of ordinary skill in the art after reading the following detailed description of the preferred embodiment that is illustrated in the various figures and drawings.

DETAILED DESCRIPTION

In the following embodiments of the present invention, a display device consisting of a plurality of sub-pixel arrays is disclosed. Each of the sub-pixel arrays comprises first sub-pixels having a first color and forming a plurality of vertexes of a virtual quadrilateral, at least one second sub-pixel having a second color, and at least one third sub-pixel having a third color, wherein the at least one second sub-pixel and the at least one third sub-pixel are located in the virtual quadrilateral formed by the first sub-pixels. By adopting the sub-pixel array of the present invention, distances between the sub-pixels can be enlarged. The transmittance and the luminance of the display device can be improved and the process difficulty of manufacturing the display device can be reduced, therefore. The present invention is particularly shown and described with respect to at least one exemplary embodiment accompanied by drawings. Words utilized for describing connections between two components such as "couple" and "connect" should not be taken as limiting a connection between the two components to be directly coupling or indirectly coupling.

Figure 1:
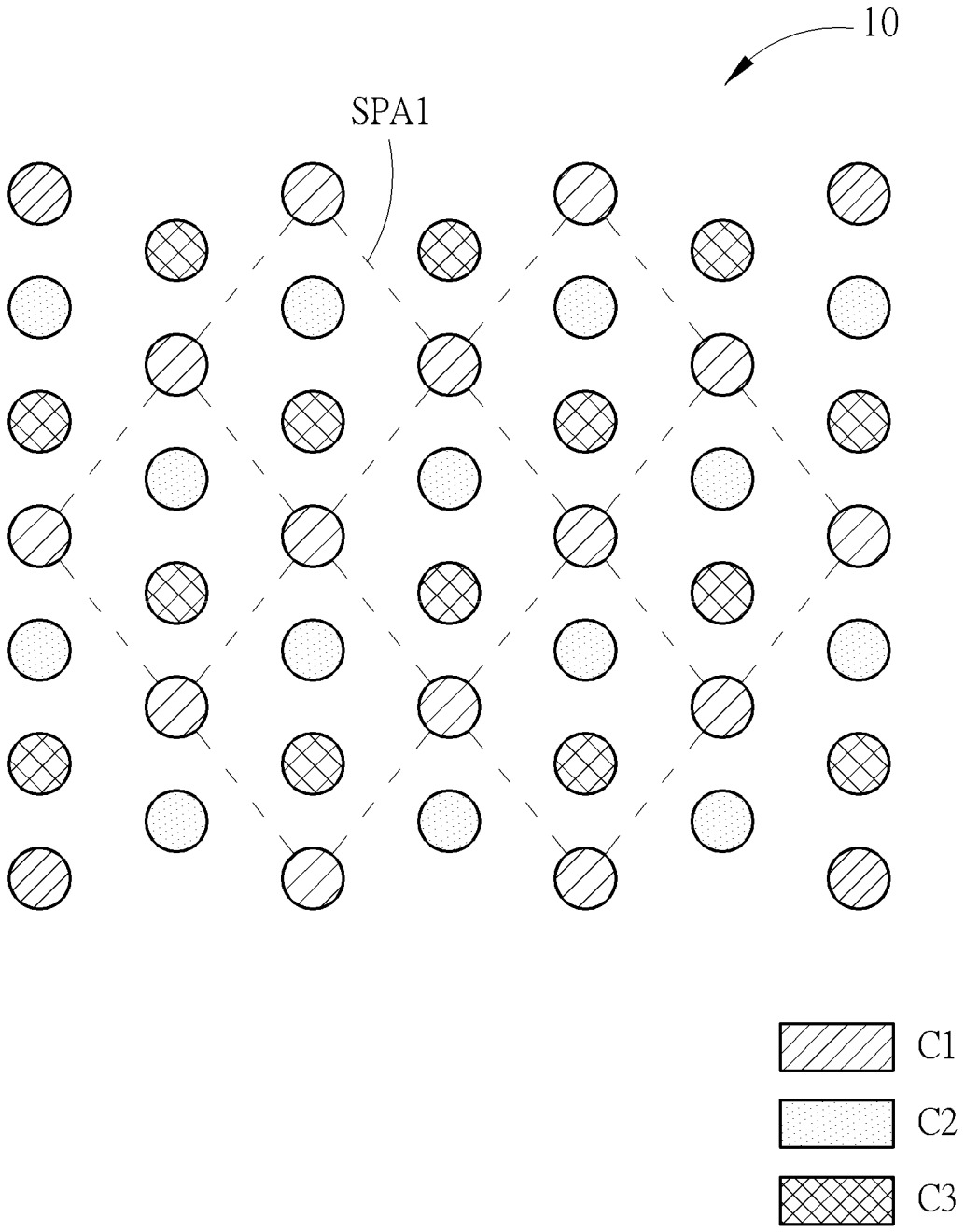
FIG. 1 is a schematic diagram of a display device according to an example of the present invention.

Please refer to FIG. 1, which is a schematic diagram of a display device 10 according to an example of the present invention. The display device 10 may be an electronic product with a display panel (e.g. a LCD panel or an OLED panel), such as a smart phone, a tablet, a laptop, and is not limited herein. Note that FIG. 1 only shows parts of sub-pixels of the display device 10 for illustrations. As shown in FIG. 1, the display device 10 consists of a plurality of sub-pixel array SPAT.

Figure 2:
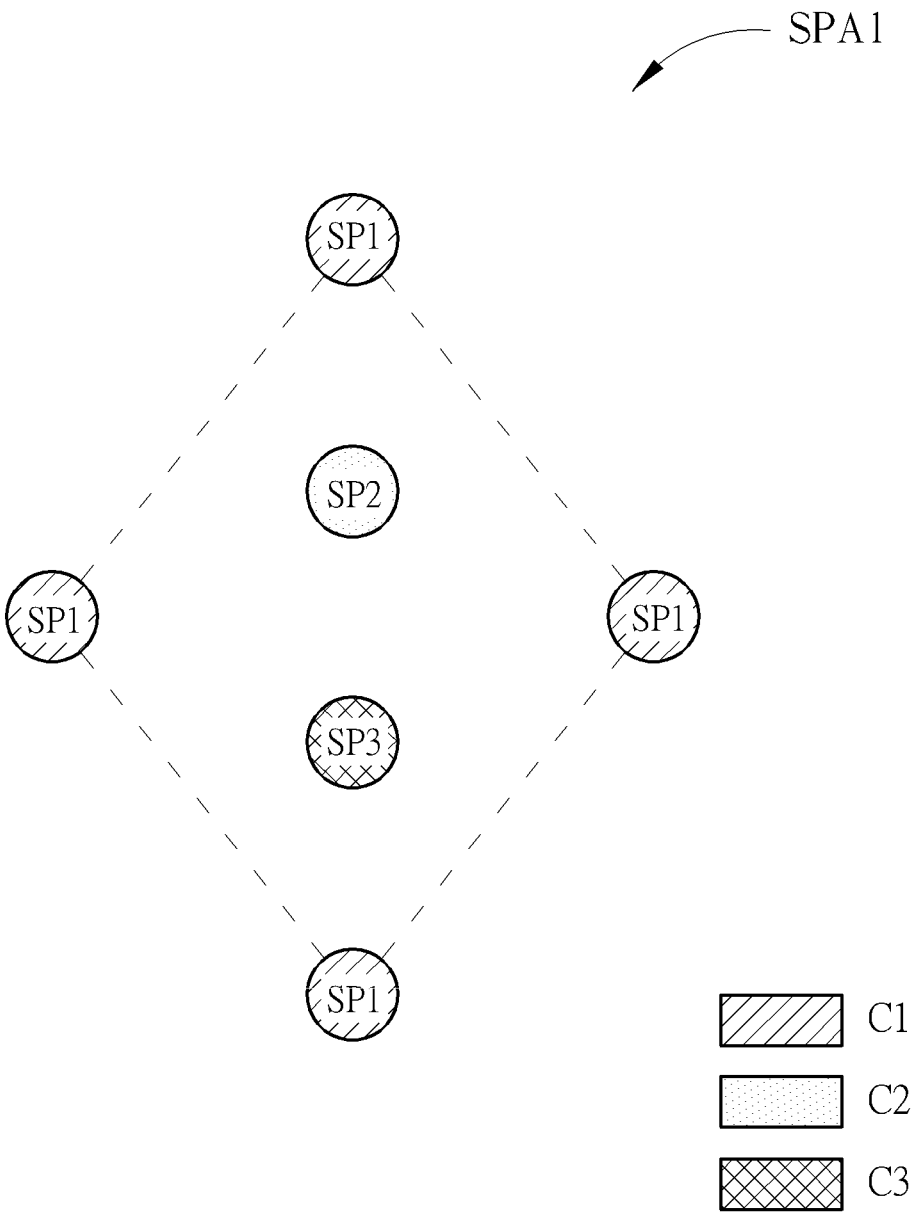
FIGS. 2-12 are schematic diagrams of sub-pixel arrays according to examples of the present invention.

As to details of the sub-pixel array SPA1, please refer to FIG. 2. As shown in FIG. 2, the sub-pixel array SPA1 comprises 4 sub-pixels SP1 of a color C1, 1 sub-pixel SP2 of a color C2 and 1 sub-pixel SP3 of a color C3. The sub-pixels SP1 form vertexes of a virtual quadrilateral and the sub-pixels SP2 and SP3 are located in the virtual quadrilateral. In this example, the sub-pixels SP2 and SP3 are arranged on a diagonal of the virtual quadrilateral. Note that, there is no sub-pixel SP1 with the color C1 in the virtual quadrilateral. According to different applications and design concepts, the colors C1-C3 may be appropriately altered. In an example, the colors C1-C3 are blue, red and green. By adopting the sub-pixel array SPA1 to form the display device 10, distances between the sub-pixels (especially those between the sub-pixels SP1 of the color C1) can be enlarged. The transmittance and the luminance of the display device 10 can be improved and the process difficulty of manufacturing the display device 10 can be reduced, therefore.

Note that, the adjacent sub-pixel arrays SPA1 in the display device 10 may share at least one sub-pixel SP1 of the color C1. In FIG. 1, the horizontally adjacent sub-pixel arrays SPA1 share 1 sub-pixel SP1, the vertically adjacent sub-pixel arrays SPA1 share 1 sub-pixel SP1, and the obliquely adjacent sub-pixel arrays SPA1 share 2 sub-pixels SP1.

Figure 3:
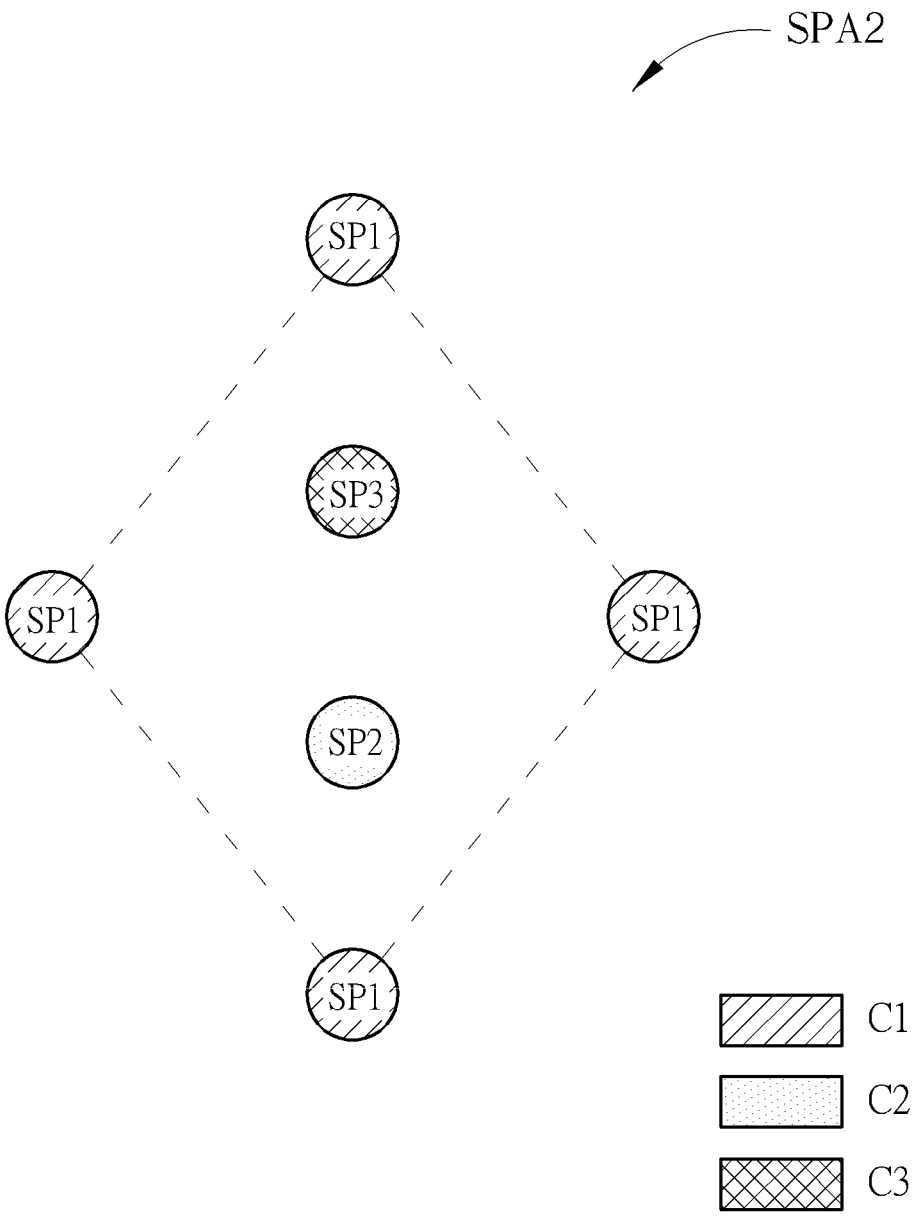

According to different applications and design concepts, the sub-pixel array forming the display device may be appropriately altered. For example, the sub-pixels SP2 and SP3 may be arranged on another diagonal of the virtual quadrilateral, on different diagonals, or on a line different from the diagonals of the virtual quadrilateral and are not limited herein. In an example, the positions of the sub-pixels of the colors C2 and C3 in the sub-pixel array SPA1 may be exchanged. Please refer to FIG. 3, which is a schematic diagram of a sub-pixel array SPA2 according to an example of the present invention. In comparison with the sub-pixel array SPA1, the sub-pixel array SPA2 exchanges the positions of the sub-pixels SP2 and SP3.

Figure 4:
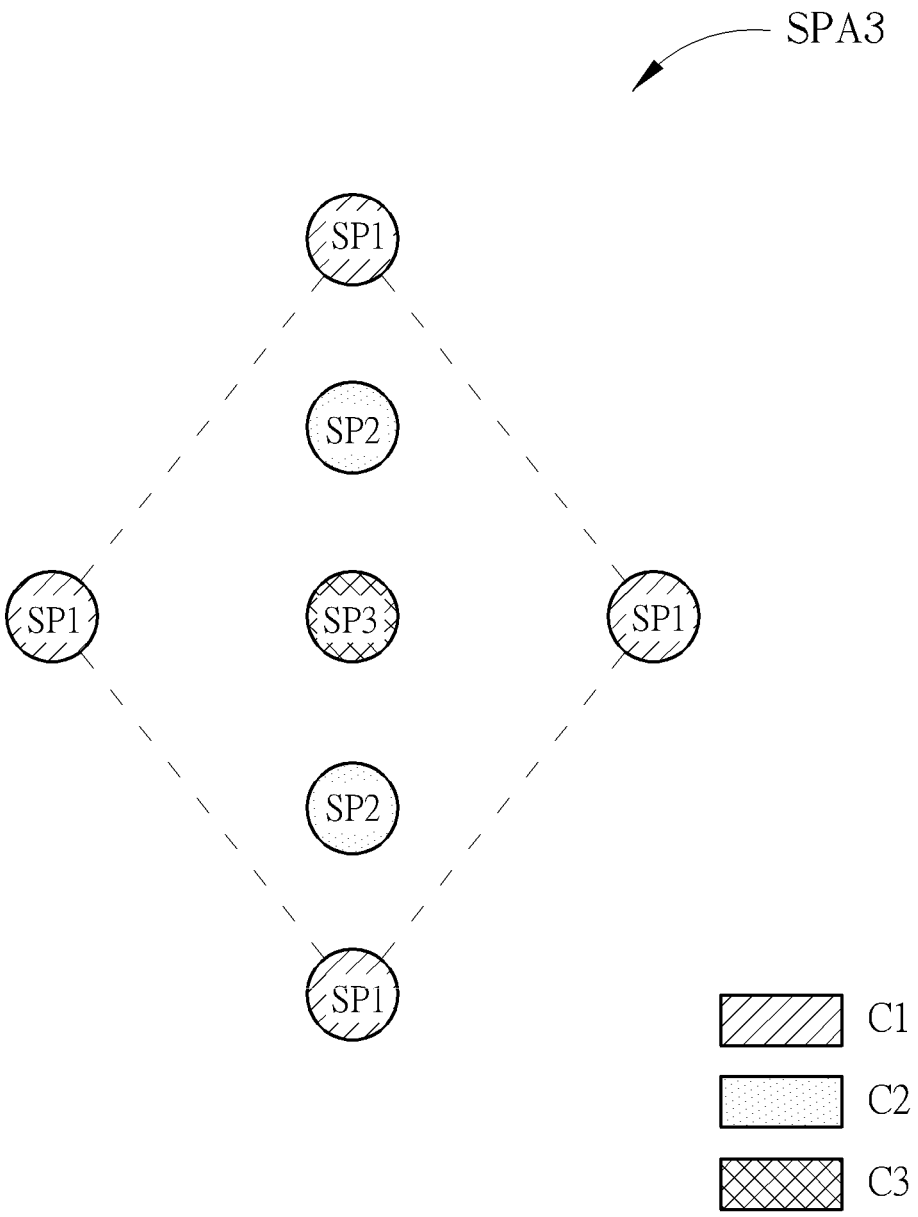

In an example, the number of sub-pixels located in the virtual quadrilateral formed by the sub-pixels SP1 of the color C1 may change. Please refer to FIG. 4, which is a schematic diagram of a sub-pixel array SPA3 according to an example of the present invention. In FIG. 4, the sub-pixel array SPA3 comprises 4 sub-pixels SP1, 2 sub-pixels SP2 and 1 sub-pixel SP3. Similar to the sub-pixels SP1 of the sub-pixel array SPA1, the sub-pixels SP1 having the color C1 in FIG. 4 form vertexes of a virtual quadrilateral. The sub-pixels SP2, SP3 and SP2 are arranged along a diagonal of the virtual quadrilateral from top to bottom. As can be seen from FIG. 4, the number of sub-pixels located in the virtual quadrilateral increases to 3.

Figure 5:
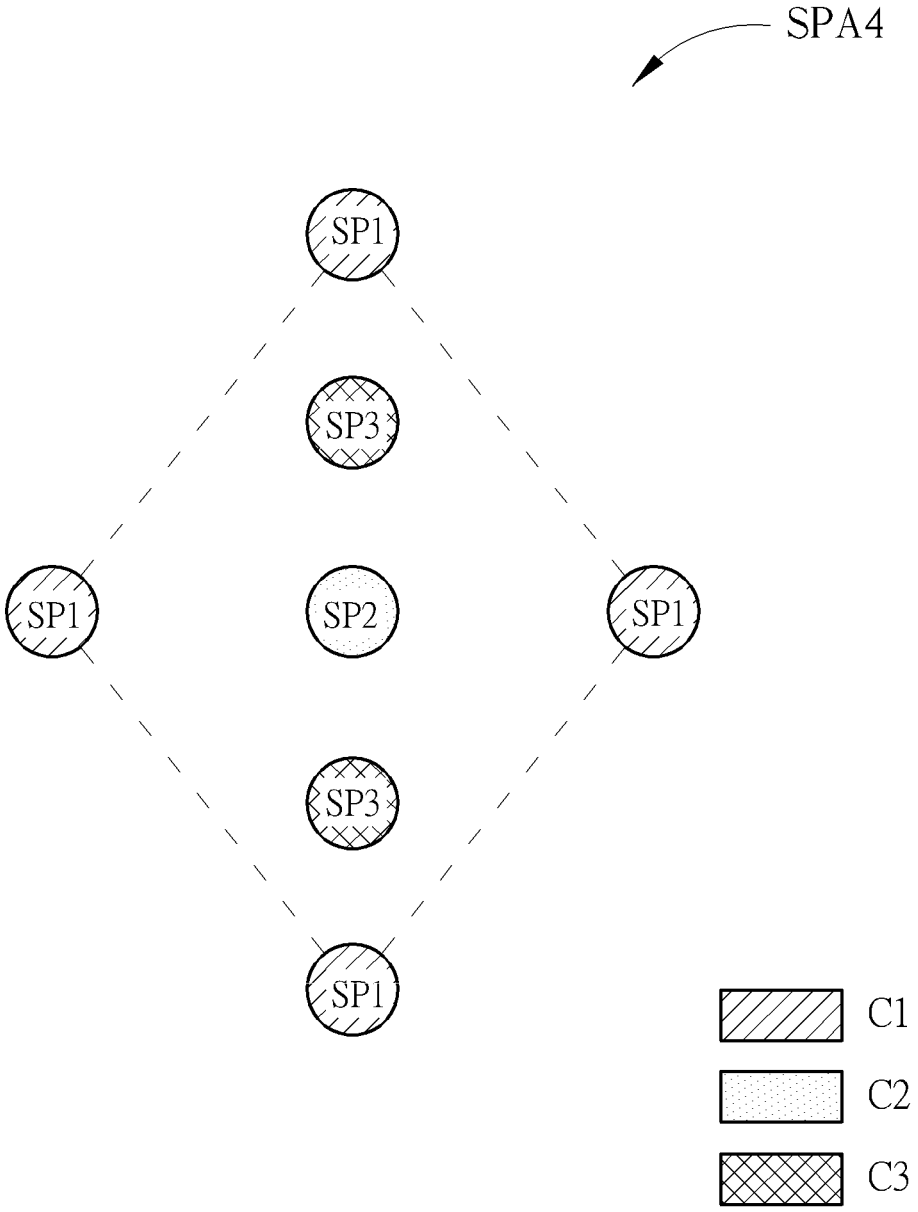

Please refer to FIG. 5, which is a schematic diagram of a sub-pixel array SPA4 according to an example of the present invention. In FIG. 5, the sub-pixel array SPA4 comprises 4 sub-pixels SP1, 1 sub-pixel SP2 and 2 sub-pixels SP3. In this example, the sub-pixels SP1 having the color C1 also form vertexes of a virtual quadrilateral and the sub-pixels SP3, SP2 and SP3 are arranged along a diagonal of the virtual quadrilateral from top to bottom.

Figure 6:
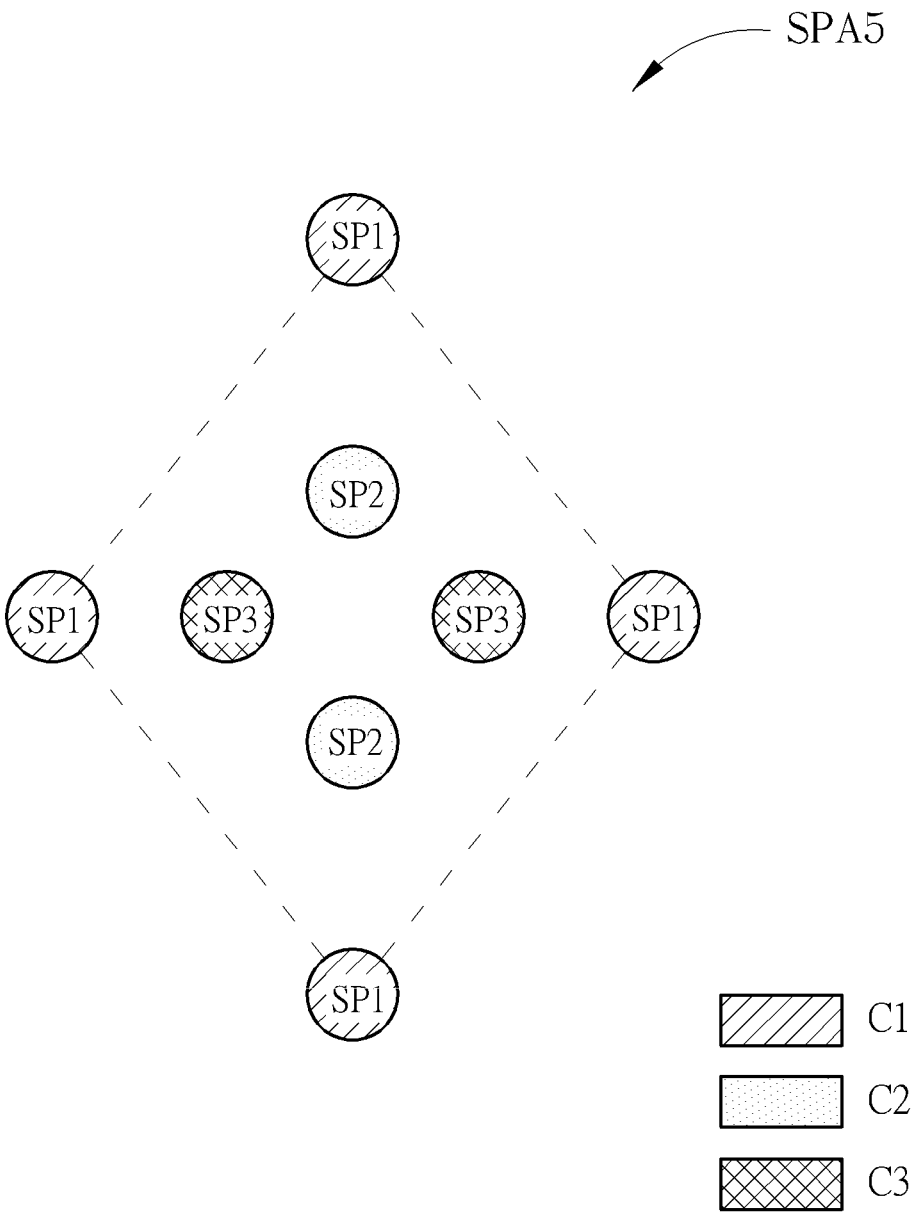

Please refer to FIG. 6, which is a schematic diagram of a sub-pixel array SPA5 according to an example of the present invention. In FIG. 6, the sub-pixel array SPA5 comprises 4 sub-pixels SP1, 2 sub-pixels SP2 and 2 sub-pixels SP3. In this example, the sub-pixels SP1 having the color C1 also form vertexes of a virtual quadrilateral. Different from the above examples, the number of the sub-pixels SP2 and SP3 located in the virtual quadrilateral increases to 4. The sub-pixels SP2 having the color C2 are arranged along a diagonal of the virtual quadrilateral and the sub-pixels SP3 are located on another diagonal of the virtual quadrilateral.

According to different applications and design concepts, the sub-pixel array SPA5 may be appropriately altered. In an example, the sub-pixels SP2 located in each sub-pixel array are arranged along a first line and the sub-pixels SP3 located in each sub-pixel array are arranged along a second line that is different from and not parallel to the first line.

Figure 7:
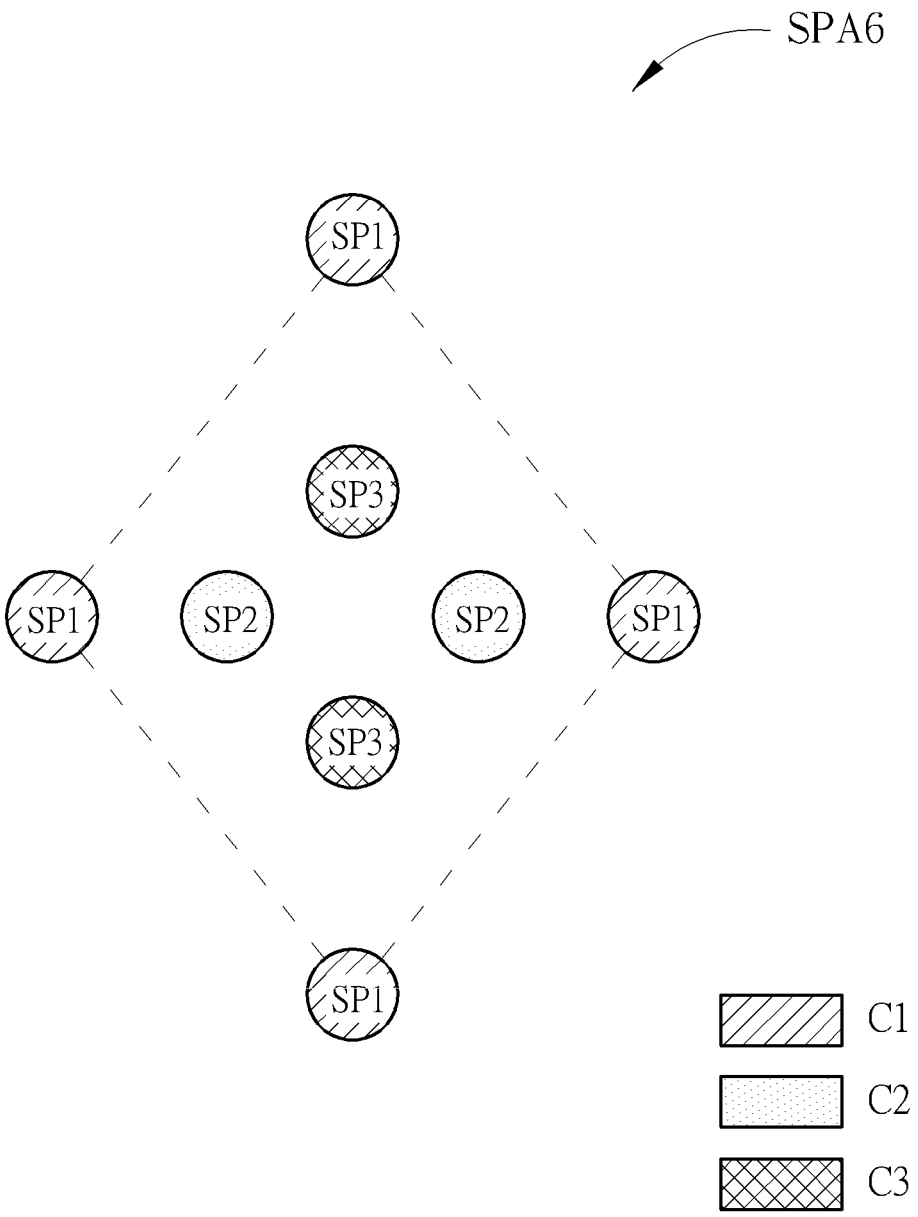

Please refer to FIG. 7, which is a schematic diagram of a sub-pixel array SPA6 according to an example of the present invention. In comparison with the sub-pixel array SPA5 shown in FIG. 6, the sub-pixel array SPA6 exchanges the positions of the sub-pixels SP2 and SP3.

In an example, the display device may be realized by repeatedly arranging a plurality of repeated units and each of the repeated units may comprise at least two of the sub-pixel arrays SPA1-SPA6. Note that, the neighboring sub-pixel arrays in each of the repeated units share at least one sub-pixel SP1 having the color C1.

Figure 8:
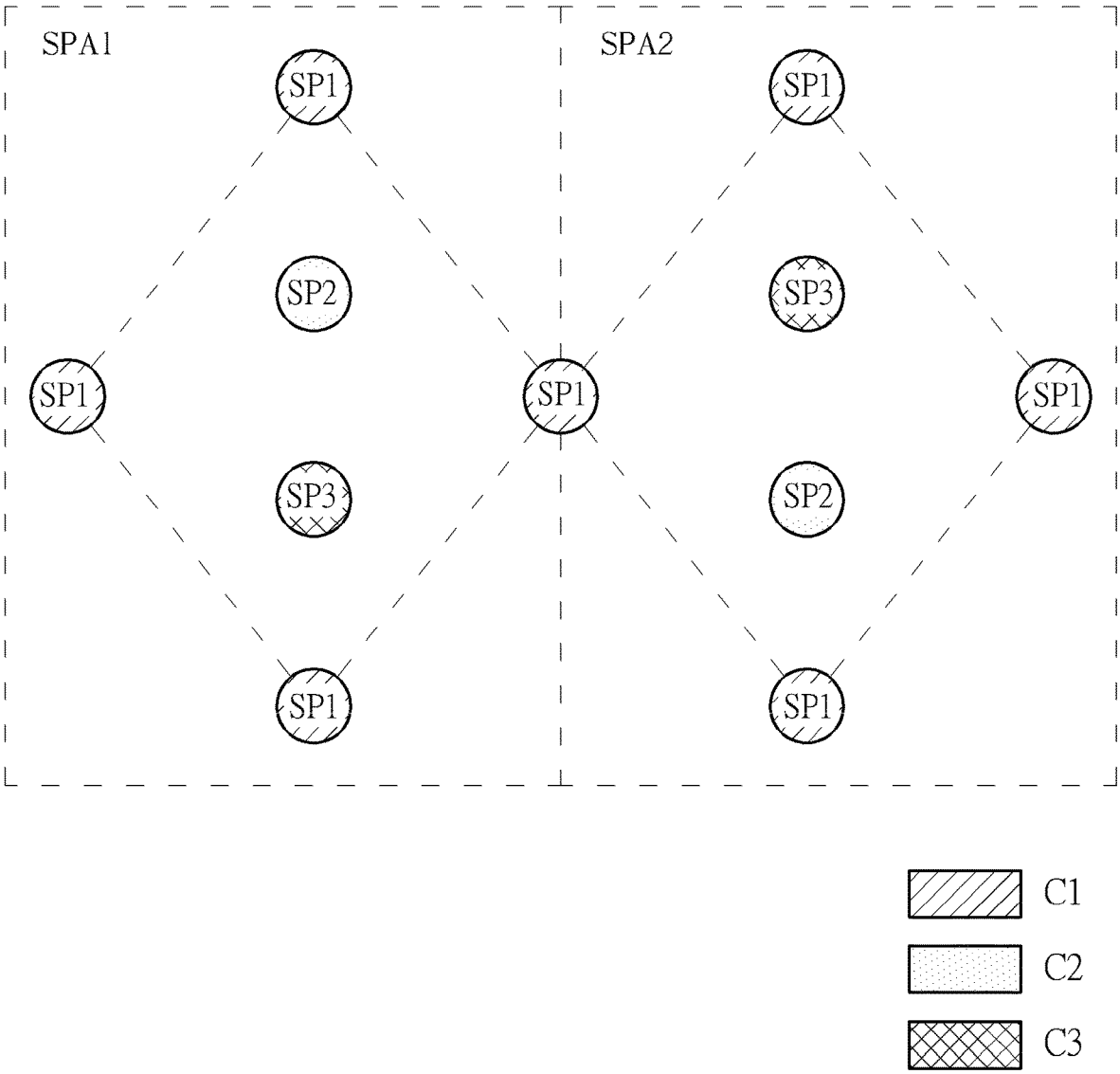

Please refer to FIG. 8, which is a schematic diagram of a repeated unit consisting of the sub-pixel arrays SPA1 and SPA2. As shown in FIG. 8, the neighboring sub-pixel arrays SPA1 and SPA2 share 1 sub-pixel SP1. Because the positions of the sub-pixels SP2 and SP3 are opposite in the sub-pixel arrays SPA1 and SPA2, the distance between the sub-pixels SP2 or SP3 can be further enlarged. The transmittance and the luminance of the display device can be improved, therefore.

Figure 9:
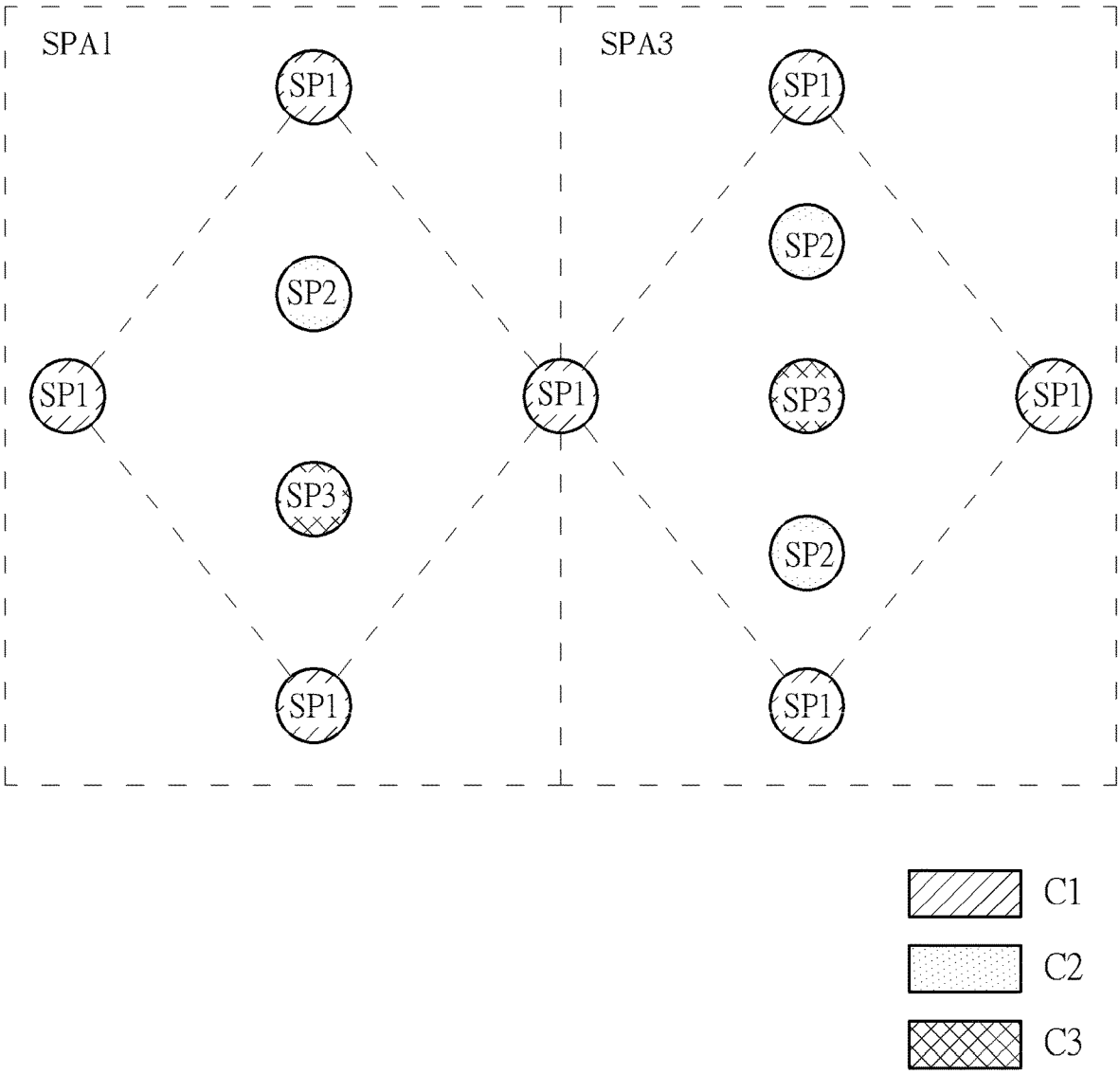

Please refer to FIG. 9, which is a schematic diagram of a repeated unit consisting of the sub-pixel arrays SPA1 and SPA3. As shown in FIG. 9, the neighboring sub-pixel arrays SPA1 and SPA3 share 1 sub-pixel SP1. Via adopting the repeated unit consisting of the sub-pixel arrays SPA1 and SPA3 to realize the display device, the distance between the sub-pixels SP2 or SP3 can be further enlarged. The transmittance and the luminance of the display device can be improved, therefore.

Figure 10:
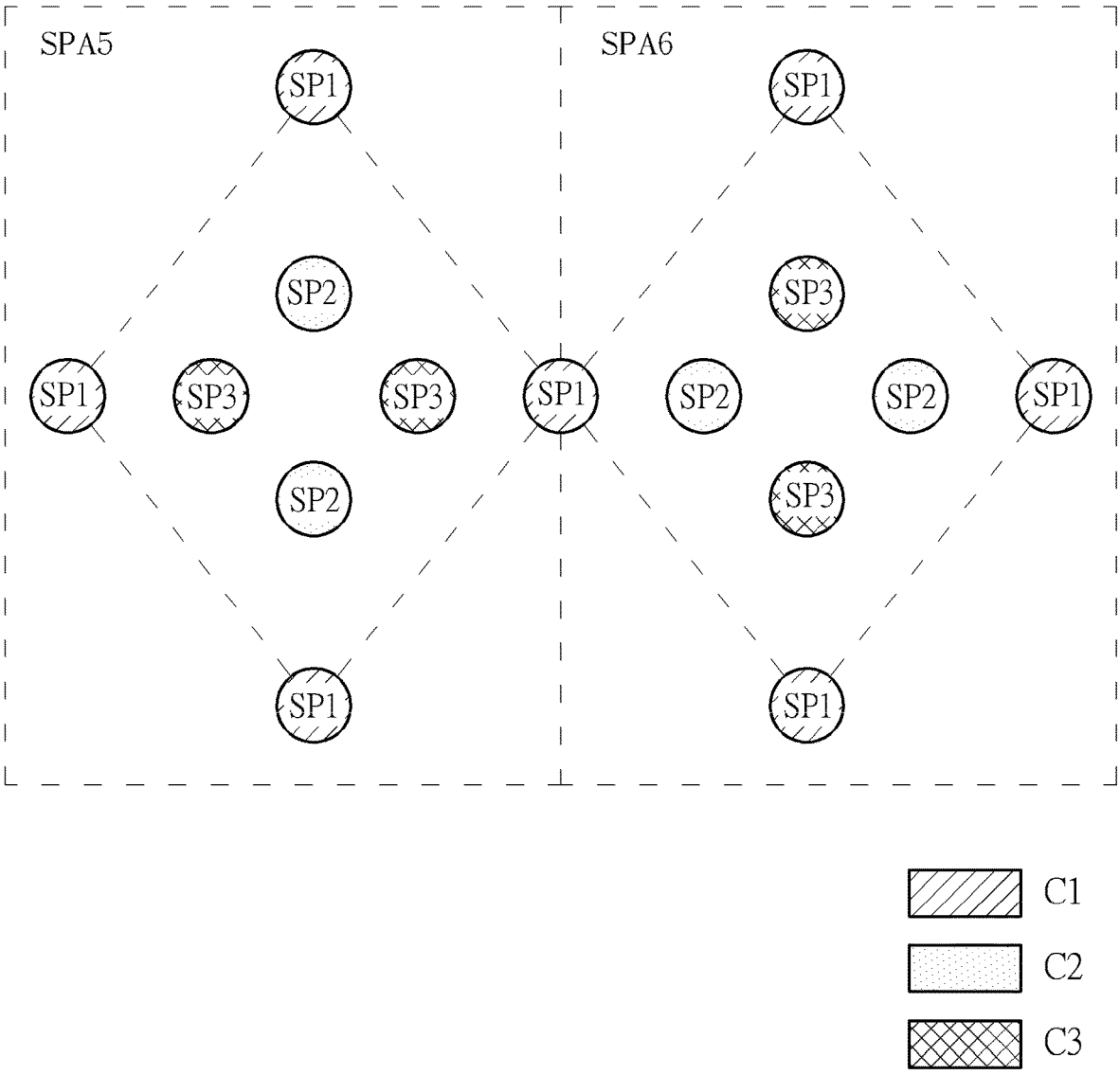

Please refer to FIG. 10, which is a schematic diagram of a repeated unit consisting of the sub-pixel arrays SPA5 and SPA6. As shown in FIG. 10, the neighboring sub-pixel arrays SPA5 and SPA6 share 1 sub-pixel SP1. Because the positions of the sub-pixels SP2 and SP3 are opposite in the sub-pixel arrays SPA5 and SPA6, the distance between the sub-pixels SP2 or SP3 can be further enlarged. The transmittance and the luminance of the display device can be improved, therefore.

Figure 11:
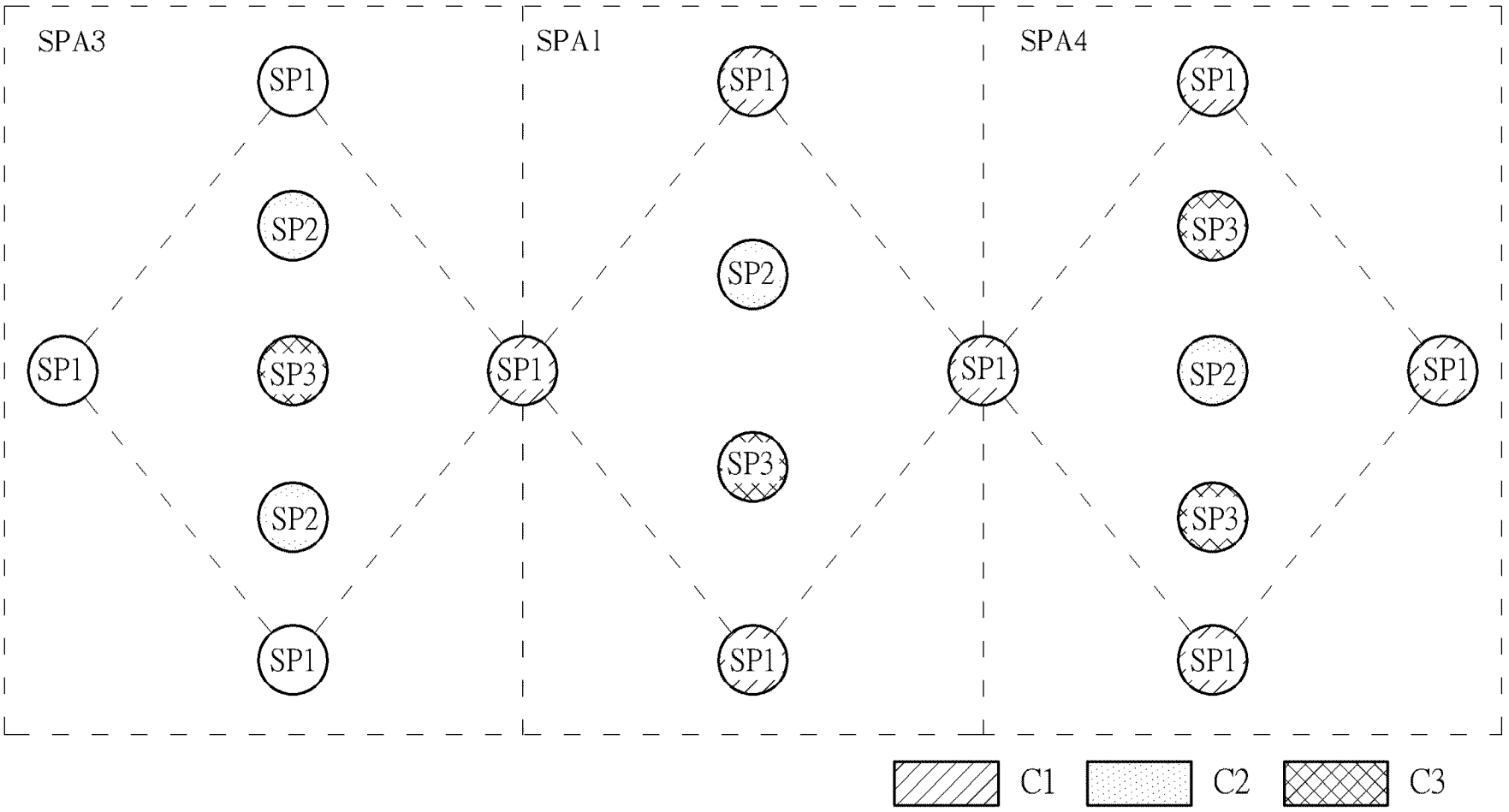

Please refer to FIG. 11, which is a schematic diagram of a repeated unit consisting of the sub-pixel arrays SPA1, SPA3 and SPA5. As shown in FIG. 11, the neighboring sub-pixel arrays SPA1 and SPA3 share 1 sub-pixel SP1 and the neighboring sub-pixel arrays SPA3 and SPA5 share 1 sub-pixel SP1. Via adopting the repeated unit consisting of the sub-pixel arrays SPA1, SPA3 and SPA5 to realize the display device, the distance between the sub-pixels SP2 or SP3 can be further enlarged. The transmittance and the luminance of the display device can be improved, therefore.

Figure 12:
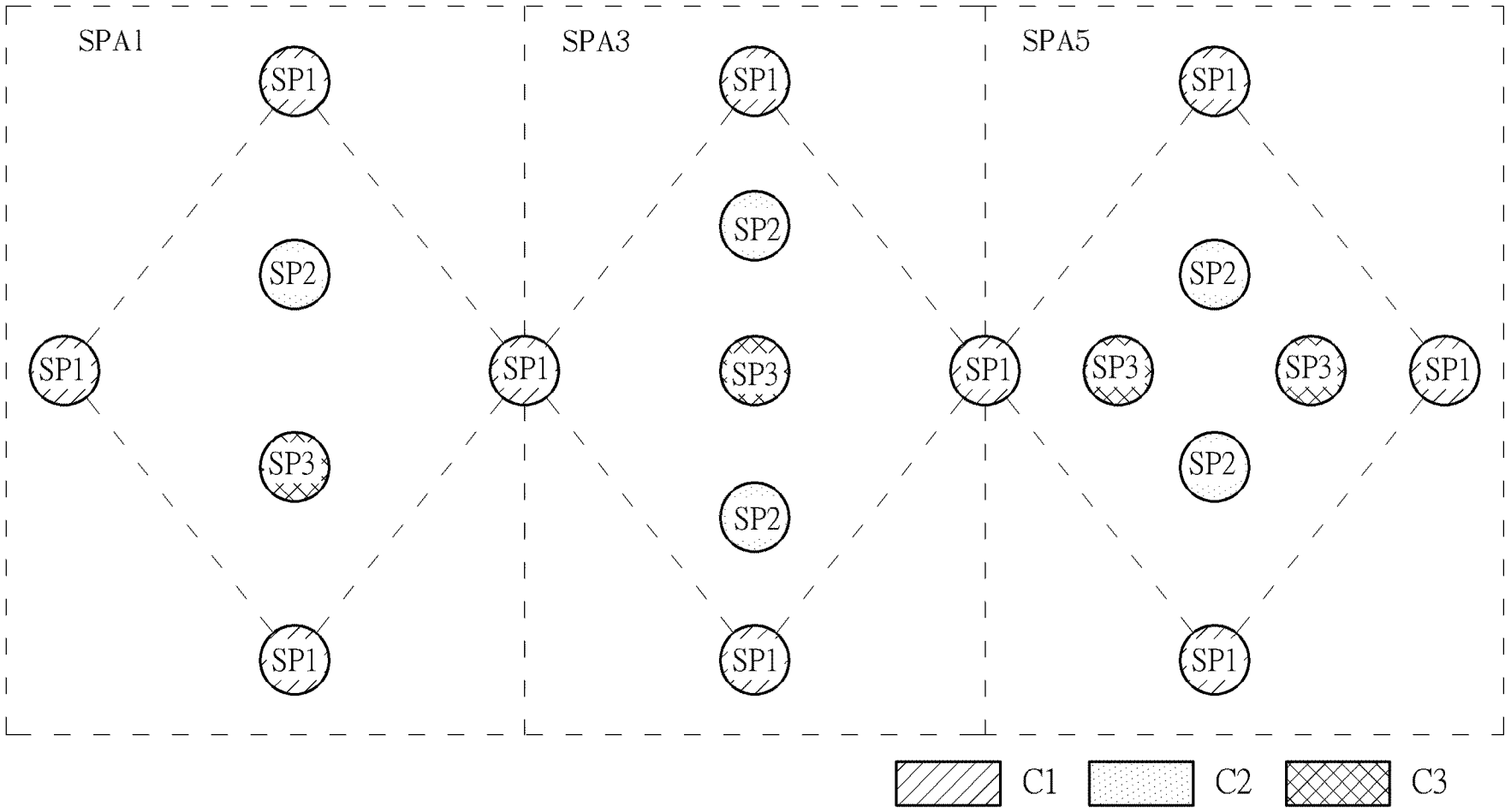

Please refer to FIG. 12, which is a schematic diagram of a repeated unit consisting of the sub-pixel arrays SPA3, SPA1 and SPA4. As shown in FIG. 12, the neighboring sub-pixel arrays SPA3 and SPA1 share 1 sub-pixel SP1 and the neighboring sub-pixel arrays SPA1 and SPA4 share 1 sub-pixel SP1. Via adopting the repeated unit consisting of the sub-pixel arrays SPA1, SPA3 and SPA5 to realize the display device, the distance between the sub-pixels SP2 or SP3 can be further enlarged. The transmittance and the luminance of the display device can be improved, therefore.

Figure 13:
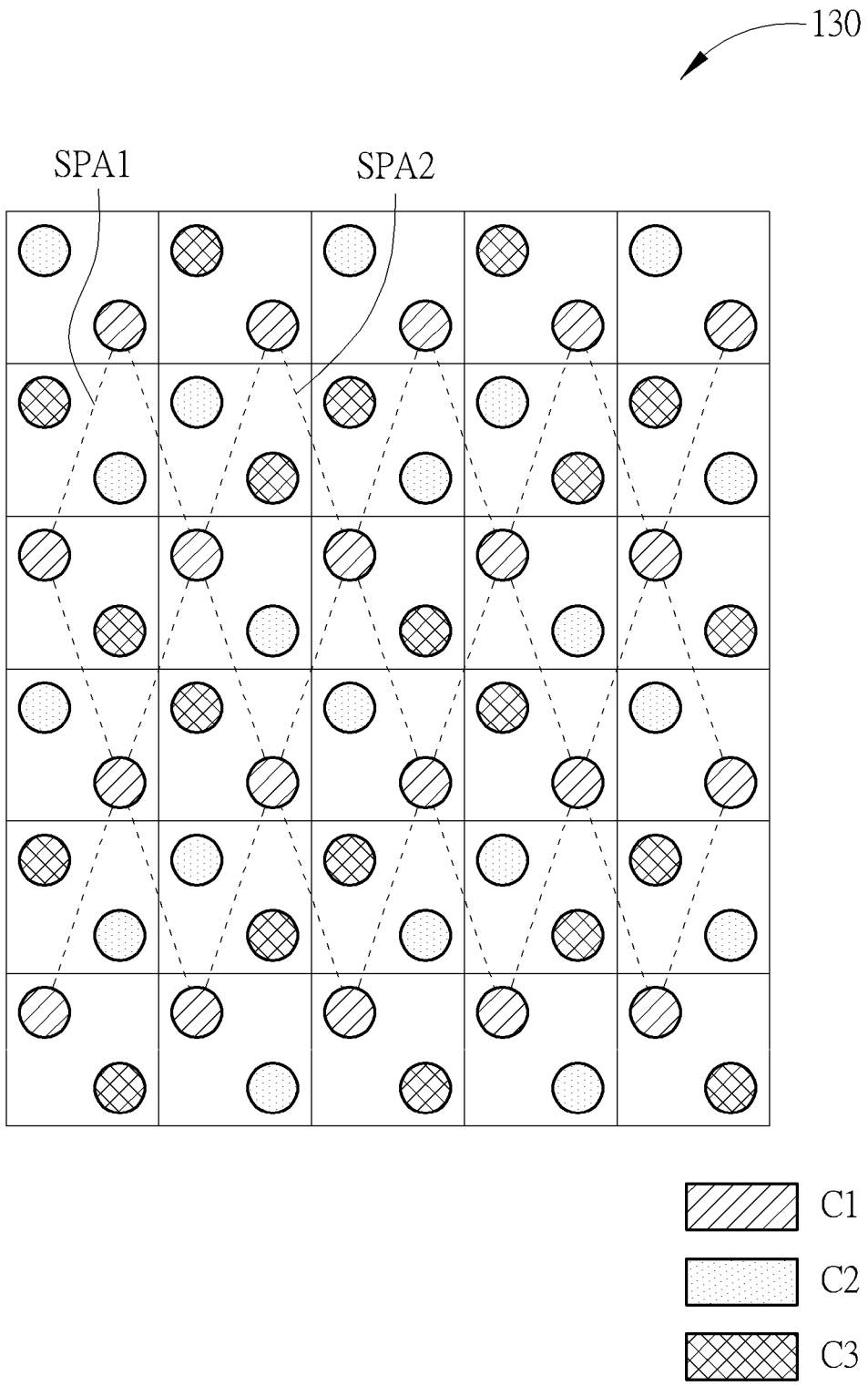
FIGS. 13-15 are schematic diagrams of display devices according to examples of the present invention.

Note that, the above examples shown in FIGS. 1-12 are utilized for illustrating the relative positions of the sub-pixels and not for limiting the ratios between length and width of each sub-pixel or the distances among the sub-pixels. According to different application and design concepts, the area corresponding to each sub-pixel may be appropriately altered. Please refer to FIG. 13, which is a schematic diagram of a display device 130 according to an example of the present invention, wherein the display device 130 is realized by repeatedly arranging the repeated unit shown in FIG. 8 (i.e. the combination of the sub-pixel arrays SPAT and SPA2). FIG. 13 only shows parts of sub-pixels in the display device 130 for illustrations.

In FIG. 13, each block circled by solid lines may correspond to 1 pixel area, wherein 1 pixel area is defined as the area corresponding to 1 real pixel (i.e. 3 sub-pixels of red, green and blue) without using a sub-pixel rendering technique. In this example, each pixel area comprises 2 sub-pixels.

Figure 14:
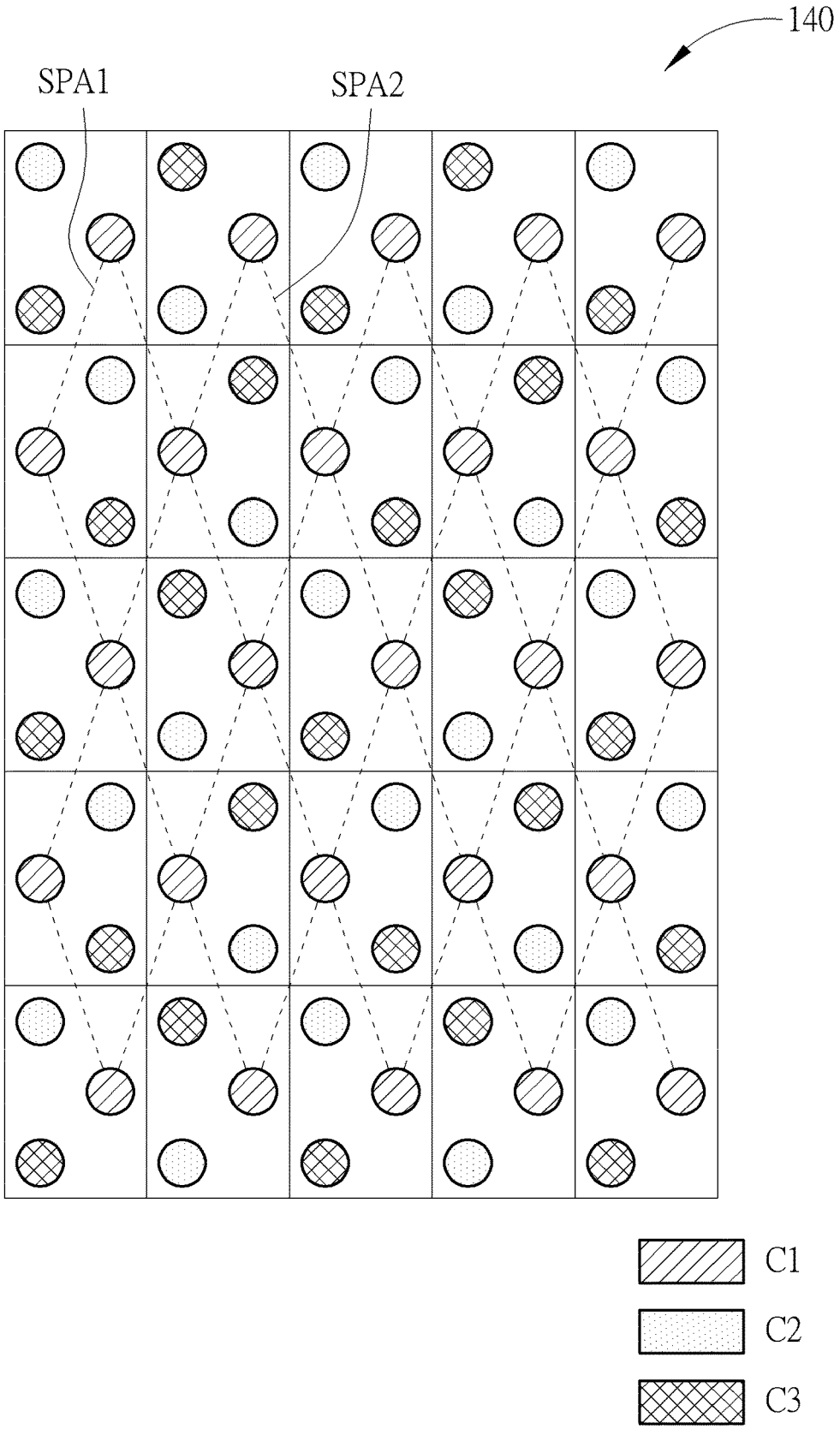

Please refer to FIG. 14, which is a schematic diagram of a display device 140 according to an example of the present invention, wherein the display device 140 is realized by repeatedly arranging the repeated unit shown in FIG. 8. FIG. 14 only shows parts of sub-pixels in the display device 140 for illustrations. In FIG. 14, each block circled by solid lines is corresponding to 1 pixel area and each pixel area changes to comprise 3 sub-pixels.

Figure 15:
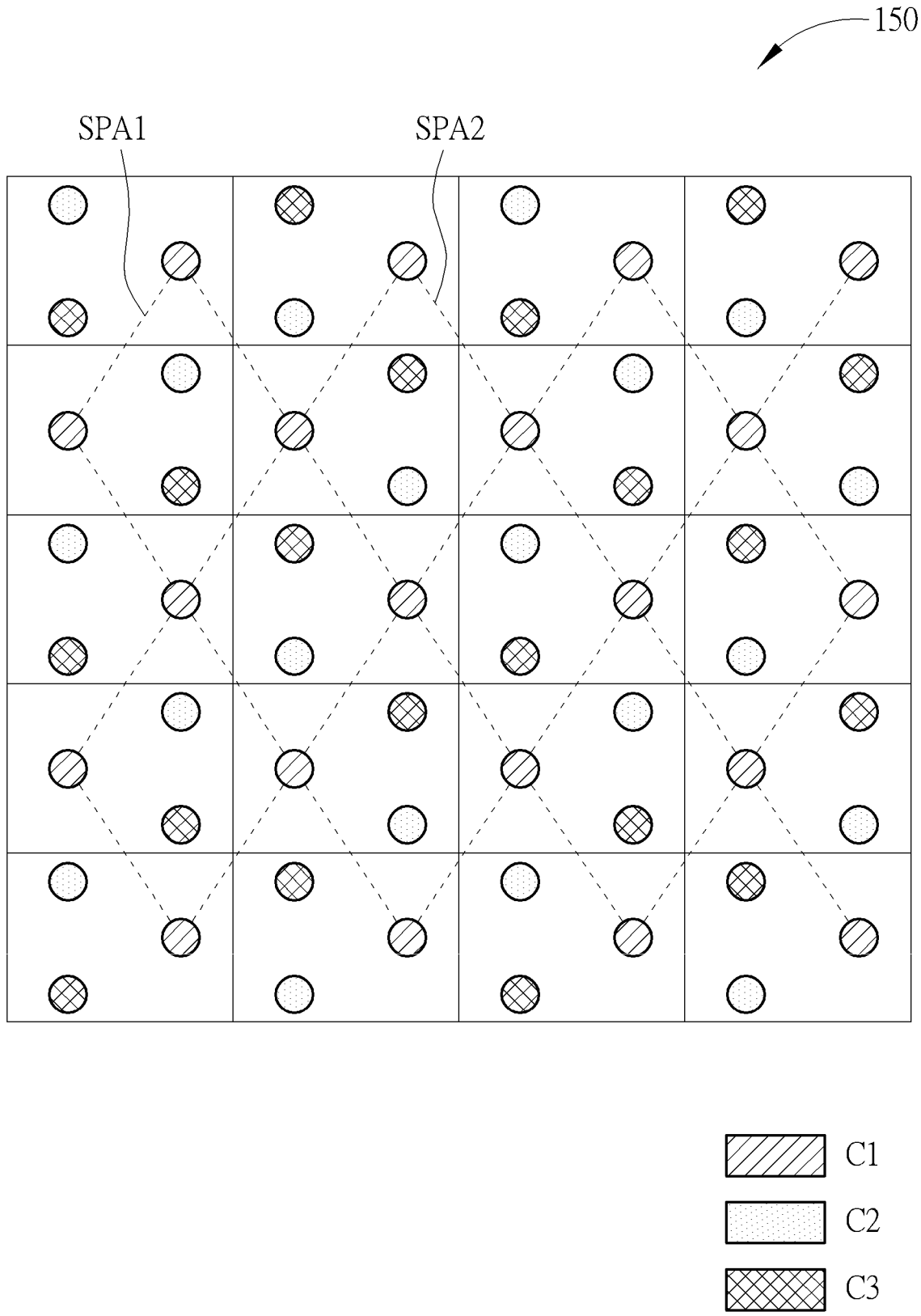

Please refer to FIG. 15, which is a schematic diagram of a display device 150 according to an example of the present invention, wherein the display device 150 is realized by repeatedly arranging the repeated unit shown in FIG. 8. FIG. 15 only shows parts of sub-pixels in the display device 150 for illustrations. In FIG. 15, each block circled by solid lines is corresponding to 2 pixel areas and comprises 3 sub-pixels. That is, each pixel area is corresponding to 1.5 sub-pixels.

Figure 16:
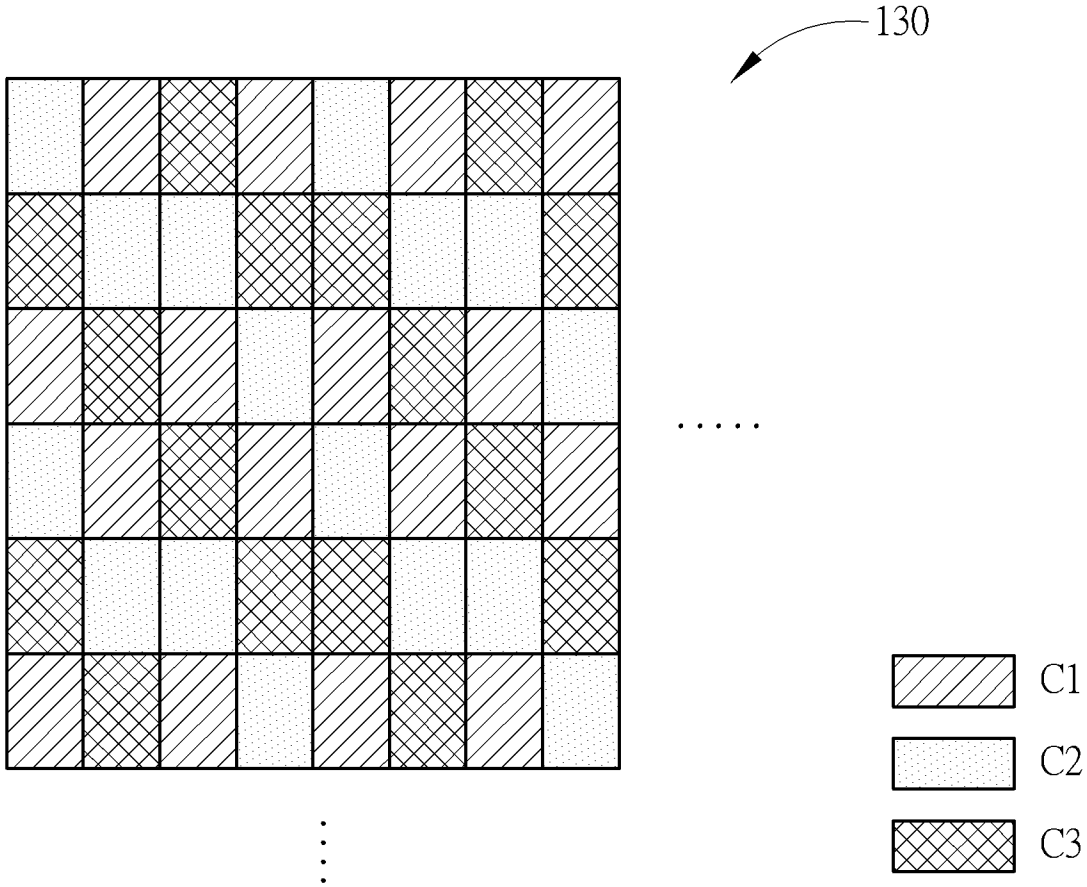
FIG. 16 is a schematic diagram of the display device shown in FIG. 13.

Please note that, the sub-pixels are represented by circles in the above examples and may be shown by different methods according to different applications. Please refer to FIG. 16, which is a schematic diagram of the display device 130 shown in FIG. 13. In this example, the sub-pixels are represented by rectangles and the sub-pixels configured in the same pixel area are configured at the same rows. In FIG. 16, the sub-pixels in the row 1 are corresponding to the colors C2, C1, C3, C1 and so on; the sub-pixels in the row 2 are corresponding to the colors C3, C2, C2, C3 and so on; the sub-pixels in the row 3 are corresponding to the colors C1, C3, C1, C2 and so on; and The sub-pixel configurations rows 4-6 are similar to those of the rows 1-3, respectively. As shown in FIG. 16, the sub-pixels in the display device 130 can be represented by the rectangular blocks.

According to different applications, the sub-pixel arrays forming the display device may be appropriately changed. For example, at least one sub-pixel SP4 having a color C4 different from colors C1-C3 may be arranged in the virtual quadrilateral formed by the sub-pixels SP1 in at least one sub-pixel array of the display device. In an example, the brightness of the color C4 may be higher than that of at least one of the colors C1-C3. Under such a condition, the luminance of the display device can be further improved.

Figure 17:
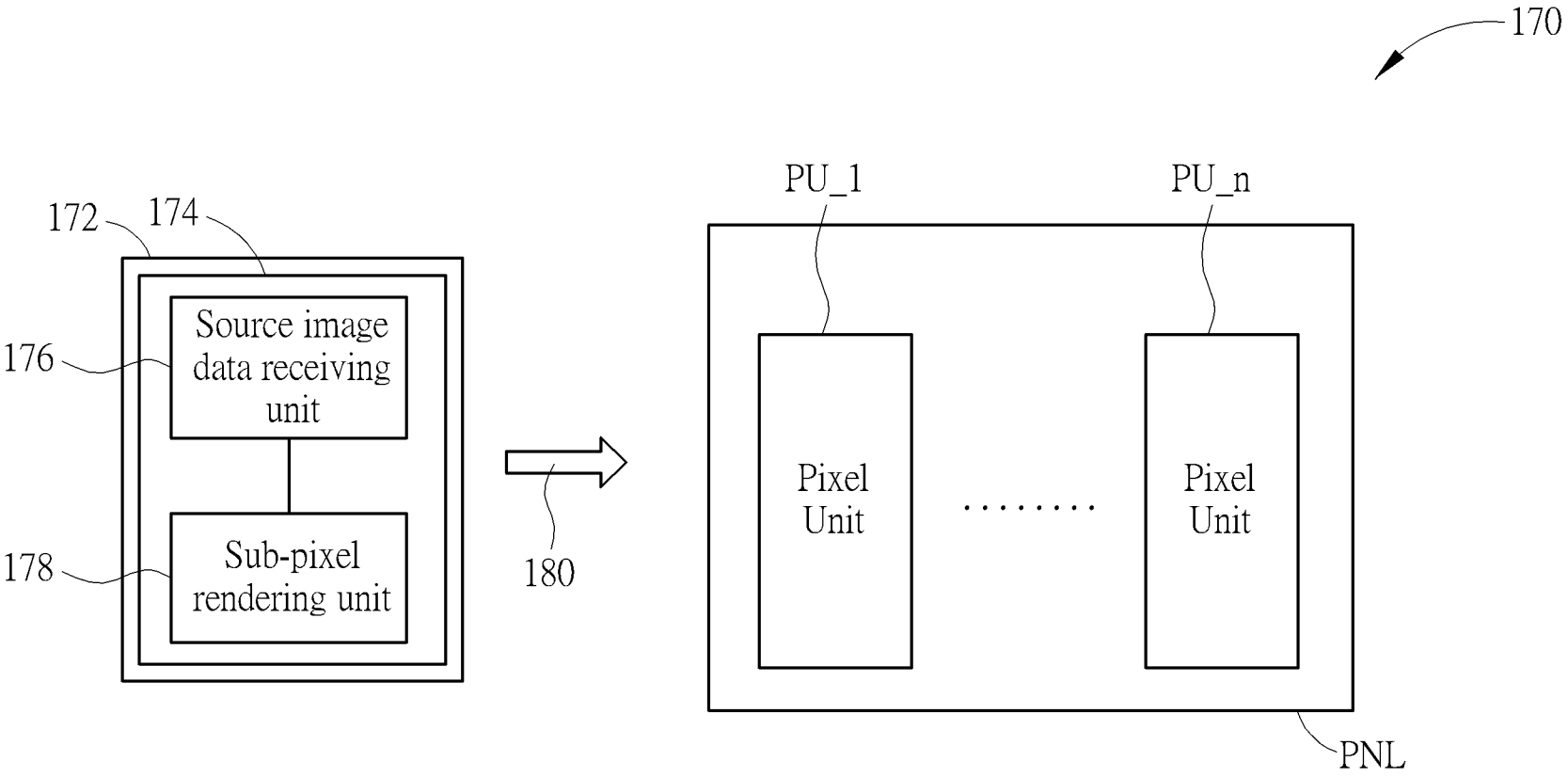
FIG. 17 is a schematic diagram of a display device according to an example of the present invention.

To drive the display device of the above examples, the display panel of the display device may be divided into a plurality of pixel units each containing at least a part of one of the sub-pixel arrays or one or more of the sub-pixel arrays, and driven by a driving device. Please refer to FIG. 17, which is a schematic diagram of a display device 170 according to an example of the present invention. The display device 170 includes a display panel PNL and a driving device 172. The display panel PNL includes a plurality of sub-pixel arrays, which may be selected from the above examples, and the display panel PNL is divided into pixel units PU_1-PU_n. In other words, each of the pixel units PU_1-PU_n may contain at least a part of one of the sub-pixel arrays or one or more of the sub-pixel arrays. The driving device 172 is used to drive the pixel units PU_1-PU_n of the display panel PNL, and includes a source driving circuit 174. The driving device 172 may further include a timing controller and/or a gate driving circuit, and is not limited thereto. The source driving circuit 174 is coupled to the display panel PNL via one or more output terminals 180, and includes a source image data receiving unit 176 and a sub-pixel rendering unit 178. The source image data receiving unit 176 is configured to receive source image data indicating an image, for rendering on the display panel PNL. The sub-pixel rendering unit 178 is configured to compute luminance values for each sub-pixel of the display panel PNL according to the source image data. Thus, the source driving circuit 174 outputs a respective drive voltage for driving sub-pixels belonging to at least one corresponding pixel unit of pixel units among the pixel units PU_1-PU_n, where the drive voltage may have a plurality of periods, and each of the period consists of image data for driving at least one sub-pixel located in one pixel unit of the at least corresponding pixel unit of pixel units.

To sum up, the distances among the sub-pixels can be enlarged by adopting the sub-pixel arrays of the embodiments to realize the display device. The transmittance and the luminance of the display device can be improved and the process difficulty of manufacturing the display device can be reduced, therefore.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device, comprising a plurality of sub-pixel arrays, wherein each of sub-pixel arrays comprises:

a plurality of first sub-pixels having a first color and forming a plurality of vertexes of a virtual quadrilateral, wherein there is not any other first sub-pixels having the first color located in the virtual quadrilateral;

at least one second sub-pixel having a second color different from the first color, located in the virtual quadrilateral; and at least one third sub-pixel having a third color different from the first color and the second color, located in the virtual quadrilateral;

wherein the display device includes three colors in total.

2. The display device of claim 1, wherein the first color is blue.

3. The display device of claim 1, wherein the first color, the second color and the third color include a blue color, a red color and a green color.

4. The display device of claim 1, wherein all of the at least one second sub-pixel and the at least one third sub-pixel are arranged along a first line.

5. The display device of claim 4, wherein the first line is one of diagonals of the virtual quadrilateral.

6. The display device of claim 1, wherein all of the at least one second sub-pixel is arranged along a first line and all of the at least one third sub-pixel is arranged along a second line not parallel with the first line.

7. The display device of claim 6, wherein the first line is one of the diagonals of the virtual quadrilateral and the second line is another one of the diagonals of the virtual quadrilateral.

8. The display device of claim 1, wherein the plurality of sub-pixel arrays are arranged as a plurality of repeated units, each repeated unit comprises multiple sub-pixel arrays, and neighboring sub-pixel arrays share at least one first sub-pixel.

9. The display device of claim 8, wherein at least two of the sub-pixels arrays in each repeated units have different quantities of sub-pixels.

10. The display device of claim 8, wherein at least two of the sub-pixels arrays in each repeated units have different patterns of sub-pixels.

11. The display device of claim 8, wherein each of the repeated units comprises a first sub-pixel array and a second sub-pixel array next to the first sub-pixel array, and the first sub-pixel array and the second sub-pixel array share at least one first sub-pixel.

12. The display device of claim 11, wherein a quantity of sub-pixels in the first sub-pixel array is different from a quantity of sub-pixels in the second sub-pixel array.

13. The display device of claim 11, wherein sub-pixel patterns of the first sub-pixel array and the second sub-pixel array are different.

14. The display device of claim 11, wherein each of the repeated units further comprises a third sub-pixel array next to the second sub-pixel array, the second sub-pixel array and the third sub-pixel array share at least one first sub-pixel.

15. The display device of claim 14, wherein sub-pixel patterns of the first sub-pixel array, the second sub-pixel array and the third sub-pixel array are different.

16. The display device of claim 1, further comprising at least one fourth sub-pixel having a fourth color different from the first color, the second color and the third color, located in the virtual quadrilateral.

17. The display device of claim 1, wherein there is no other sub-pixel having a color different from the first color, the second color and the third color located in the virtual quadrilateral.

18. The display device of claim 1, wherein there is not any other sub-pixels on a connection line connecting two adjacent vertexes among the plurality of vertexes of the virtual quadrilateral.

19. The display device of claim 1, wherein there are two sub-pixels in total located in each virtual quadrilateral.

20. A driving device, capable for driving a display panel comprising a plurality of sub-pixel arrays, wherein each of sub-pixel arrays comprises: a plurality of first sub-pixels having a first color, forming a plurality of vertexes of a virtual quadrilateral, wherein there is not any other first sub-pixels having the first color located in the virtual quadrilateral; at least one second sub-pixel having a second color different from the first color, located in the virtual quadrilateral; and at least one third sub-pixel having a third color different from the first color and the second color, located in the virtual quadrilateral, wherein the display panel is divided into a plurality of pixel units each containing at least a part of one of the sub-pixel arrays or one or more of the sub-pixel arrays, wherein the driving device comprises:

a source driving circuit, having one or more output terminals, wherein each output terminal is configured to output a respective drive voltage for driving sub-pixels belonging to at least one corresponding pixel unit of pixel units among the pixel units of the display panel;

wherein the display panel includes three colors in total.

21. The driving device of claim 20, wherein the drive voltage has a plurality of periods, and each of the period consists of image data for driving at least one sub-pixel located in one pixel unit of the at least corresponding pixel unit of pixel units.

22. The driving device of claim 20, wherein the source driving circuit further comprises:

a source image data receiving unit configured to receive source image data indicating an image, for rendering on the display panel; and a sub-pixel rendering unit configured to compute luminance values for each sub-pixel of the display panel according to the source image data.

23. The driving device of claim 20, wherein the plurality of sub-pixel arrays are arranged as a plurality of repeated units, each repeated unit comprises multiple sub-pixel arrays, neighboring sub-pixel arrays share at least one of the first sub-pixels, and at least two of the sub-pixel arrays in each repeated units have different quantities of sub-pixels.

24. The driving device of claim 20, wherein there is not any other sub-pixels on a connection line connecting two adjacent vertexes among the plurality of vertexes of the virtual quadrilateral.

25. The driving device of claim 20, wherein there are two sub-pixels in total located in each virtual quadrilateral.

26. A display device, comprising:

a display panel, comprising:

a plurality of sub-pixel arrays, wherein each of sub-pixel arrays comprises:

a plurality of first sub-pixels having a first color, forming a plurality of vertexes of a virtual quadrilateral, wherein there is not any other first sub-pixels having the first color located in the virtual quadrilateral;

at least one second sub-pixel having a second color different from the first color, located in the virtual quadrilateral; and at least one third sub-pixel having a third color different from the first color and the second color, located in the virtual quadrilateral, wherein the display panel is divided into a plurality of pixel units each containing at least a part of one of the sub-pixel arrays or one or more of the sub-pixel arrays; and a driving device, configured to drive the pixel units on the display panel;

wherein the display panel includes three colors in total.

27. The display device of claim 26, wherein the driving device comprises a source driving circuit, having one or more output terminals, wherein each output terminal is configured to output a respective drive voltage for driving sub-pixels belonging to at least one corresponding pixel unit of pixel units among the pixel units of the display panel.

28. The display device of claim 27, wherein the drive voltage has a plurality of periods, and each of the period consists of image data for driving at least one sub-pixel located in one pixel unit of the at least corresponding pixel unit of pixel units.

29. The display device of claim 27, wherein in the source driving circuit further comprises:

a source image data receiving unit configured to receive source image data indicating an image, for rendering on the display panel; and a sub-pixel rendering unit configured to compute luminance values for each sub-pixel of the display panel according to the source image data.

30. The display device of claim 26, wherein the plurality of sub-pixel arrays are arranged as a plurality of repeated units, each repeated unit comprises multiple sub-pixel arrays, neighboring sub-pixel arrays share at least one of the first sub-pixels, and at least two of the sub-pixel arrays in each repeated units have different quantities of sub-pixels.

31. The display device of claim 26, wherein there is not any other sub-pixels on a connection line connecting two adjacent vertexes among the plurality of vertexes of the virtual quadrilateral.

32. The display device of claim 26, wherein there are two sub-pixels in total located in each virtual quadrilateral.

33. A display device, comprising a plurality of sub-pixel arrays, wherein each of sub-pixel arrays comprises:

a plurality of first sub-pixels having a first color and forming a plurality of vertexes of a virtual quadrilateral, wherein there is not any other first sub-pixels having the first color located in the virtual quadrilateral, and there is not any other sub-pixels on a connection line connecting two adjacent vertexes among the plurality of vertexes of the virtual quadrilateral;

at least one second sub-pixel having a second color different from the first color, located in the virtual quadrilateral; and at least one third sub-pixel having a third color different from the first color and the second color, located in the virtual quadrilateral;

wherein there are two sub-pixels in total located in each virtual quadrilateral, and wherein the display device includes three colors in total.

34. A driving device, capable for driving a display panel comprising a plurality of sub-pixel arrays, wherein each of sub-pixel arrays comprises: a plurality of first sub-pixels having a first color, forming a plurality of vertexes of a virtual quadrilateral, wherein there is not any other first sub-pixels having the first color located in the virtual quadrilateral, and there is not any other sub-pixels on a connection line connecting two adjacent vertexes among the plurality of vertexes of the virtual quadrilateral; at least one second sub-pixel having a second color different from the first color, located in the virtual quadrilateral; and at least one third sub-pixel having a third color different from the first color and the second color, located in the virtual quadrilateral, wherein the display panel is divided into a plurality of pixel units each containing at least a part of one of the sub-pixel arrays or one or more of the sub-pixel arrays, wherein the driving device comprises:

a source driving circuit, having one or more output terminals, wherein each output terminal is configured to output a respective drive voltage for driving sub-pixels belonging to at least one corresponding pixel unit of pixel units among the pixel units of the display panel;

wherein there are two sub-pixels in total located in each virtual quadrilateral, and wherein the display panel includes three colors in total.

35. A display device, comprising:

a display panel, comprising:

a plurality of sub-pixel arrays, wherein each of sub-pixel arrays comprises:

a plurality of first sub-pixels having a first color, forming a plurality of vertexes of a virtual quadrilateral, wherein there is not any other first sub-pixels having the first color located in the virtual quadrilateral, and there is not any other sub-pixels on a connection line connecting two adjacent vertexes among the plurality of vertexes of the virtual quadrilateral;

at least one second sub-pixel having a second color different from the first color, located in the virtual quadrilateral; and at least one third sub-pixel having a third color different from the first color and the second color, located in the virtual quadrilateral, wherein the display panel is divided into a plurality of pixel units each containing at least a part of one of the sub-pixel arrays or one or more of the sub-pixel arrays; and a driving device, configured to drive the pixel units on the display panel;

wherein there are two sub-pixels in total located in each virtual quadrilateral, and wherein the display panel includes three colors in total.

* * * * *